US006371795B1

(12) United States Patent
Yamamoto et al.

(10) Patent No.: US 6,371,795 B1
(45) Date of Patent: Apr. 16, 2002

(54) MOUNTED STRUCTURE OF ON-CONNECTOR COVER

(75) Inventors: Hiroshi Yamamoto; Takehiro Nakayama, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/574,071

(22) Filed: May 18, 2000

(30) Foreign Application Priority Data

Jun. 2, 1999 (JP) ..... 11-155374

(51) Int. Cl.[7] ..... H01R 13/58
(52) U.S. Cl. ..... 439/468; 439/686; 439/521
(58) Field of Search ..... 439/468, 456, 439/466, 473, 902, 459, 686, 367, 519, 521

(56) References Cited

U.S. PATENT DOCUMENTS 2,953,765 A * 9/1960 Greasley ..... 439/468
3,721,941 A * 3/1973 Wisser ..... 439/686
4,921,454 A * 5/1990 Atherton et al. ..... 439/456
5,453,578 A * 9/1995 Ishii et al. ..... 439/521
5,672,078 A * 9/1997 Fukamachi et al. ..... 439/902
5,695,358 A * 12/1997 Myer et al. ..... 439/468
6,030,256 A * 2/2000 Cappe ..... 439/598
6,095,852 A * 8/2000 Gregory, III ..... 439/466
6,162,087 A * 12/2000 Hiura ..... 439/521

FOREIGN PATENT DOCUMENTS

EP 0571962 A2 * 1/1993 ..... 439/521
GB 2223132 3/1990
JP 8-83641 3/1996

* cited by examiner

*Primary Examiner*—Tho D. Ta
(74) *Attorney, Agent, or Firm*—Oblon, Spivak, McClelland, Maier & Neustadt, P.C.

(57) ABSTRACT

A mounted structure of an on-connector cover includes: a connector from which an electric wire is drawn out at a rear end of the connector; and an on-connector cover covering a rear portion of the connector. In the structure, cover-guiding wall portions are formed on each of both side walls of the connector; guiding groove portions into which the cover-guiding wall portions are respectively inserted are formed in each of both side walls of the on-connector cover; and the on-connector cover covers at least three side surfaces of a rear portion of the connector.

10 Claims, 6 Drawing Sheets

MOUNTED STRUCTURE OF ON-CONNECTOR COVER

BACKGROUND OF THE INVENTION

1. Field of the Invention

The present invention relates to a mounted structure of an on-connector cover that is mounted on a connector for connecting both of distributed wires to each other.

2. Description of the Prior Art

As a conventional on-connector cover there is known a technique that is disclosed in Japanese Patent Application Laid-Open No. 8-83641. FIG. 1 is a perspective view illustrating a connector 1 and an on-connector cover 2.

First, an explanation will be given of the construction of the connector 1 prior to the explanation of the construction of the on-connector cover 2. In the connector 1, as illustrated in FIG. 1, a plate-like portion 3 is extended from an edge portion constituting one side of one end surface of a rectangular-parallelopiped-like connector main body 1A. The connector main body 1A has formed therein a plurality of terminal insertion holes 4, within each of that there is disposed a terminal metal fitting 5 having an electric wire W connected thereto. On both side surfaces on a said one end surface side of the connector main body 1A there are projectingly provided engaging/retaining pawls 6 so that these pawls 6 may be directed sideward. It is to be noted that the terminal metal fitting 5 is located within an opening (not illustrated) formed in the other end surface of the connector main body 1A. It is thereby arranged that this terminal metal fitting 5 be electrically connected to another connector (not illustrated) side to be connected to the connector 1.

Next, the construction of the on-connector 2 will be explained. The on-connector cover is generally constructed of a large-width groove portion 7, a small-width groove portion 8 that is projectingly formed on one end of the large-width groove portion 7, and engaging/retaining leg portions 9 extended from both sides of the other end of the large-width groove portion 7. In this on-connector cover 2, in a state of its being mounted on the connector 1, the following arrangement is made. Namely, a plurality of the electric wires W connected to the terminal metal fittings 5 accommodated within the connector 1 are received within the grooves of the large-width groove portion 7 and the small-width groove portion 8 (in FIG. 1 located on a lower-surface side of the on-connector cover 2). Also, in the on-connector cover 2, by the engaging/retaining leg portions 9 being engaged with and retained by the engaging/retaining pawls 6 formed on both sides of the connector 1, a mounted state of the cover 2 is maintained.

However, in the above-described conventional techniques, the cover 2 is certainly retained by the connector 1 through the engagement of the engaging/retaining leg portions 9 of the on-connector cover 2 with the engaging/retaining pawls 6 formed on both sides of the connector 1. But the lower portion of the on-connector cover 2 is not retained by the connector 1 side. Therefore, the on-connector cover 2 is likely to totter about the portion of engagement/retention between the engaging/retaining leg portion 9 and the engaging/retaining pawl 6 as a fulcrum. Therefore, the on-connector cover had the problem that its retention strength was low.

SUMMARY OF THE INVENTION

Therefore, an object of the present invention is to provide a mounted structure of an on-connector cover where the above problem to be solved by the resides in what means should be taken in order to obtain a mounted structure of an on-connector cover that is not only suitable for the mounting onto a small-sized connector but, when having been mounted, is also retained with a high strength.

A first aspect of the present invention provides a mounted structure of an on-connector cover comprising: a connector from which an electric wire is drawn out at a rear end of the connector; and an on-connector cover covering a rear portion of the connector, wherein cover-guiding wall portions are formed on each of both side walls of the connector; guiding groove portions into which the cover-guiding wall portions are respectively inserted are formed in each of both side walls of the on-connector cover; and the on-connector cover covers at least three side surfaces of a rear portion of the connector.

Accordingly, in the first aspect of the present invention, because the on-connector cover is fitted onto the connector in such a way as to cover at least three side surfaces of the rear portion of the connector, the force of retaining the on-connector cover by the connector can be made large against the load vertically applied from below to above or horizontally from left or right. Also, according to the first aspect, it is constructed that the guiding groove portions formed in the inner surfaces of both side walls of the on-connector cover be engaged with the protruding portions formed on both side walls of the connector. Therefore, the mounted structure of the first aspect has durability even against the load that presses the on-connector cover from below to above. For this reason, the on-connector cover becomes unlikely to be disengaged against the load applied horizontally as well as vertically. Accordingly, the mounting of the cover can be performed with a high rigidity.

A second aspect of the present invention provides a mounted structure of an on-connector cover in that, in the mounted structure of an on-connector cover of the first aspect, the cover-guiding wall portions are formed two or more in number on each side wall of the connector so as to become parallel with each other, and in each of the inner surfaces of the side walls of the on-connector cover, the guiding groove portions that are the same in number as the cover-guiding wall portions are formed in correspondence with the cover-guiding wall portions.

According to the second aspect, a plurality of the cover-guiding wall portions are formed on the side wall of the connector. Therefore, by engaging these cover-guiding wall portions with the guiding groove portions, it is possible to suppress vertical totter of the on-connector cover and thereby to improve the cover-retaining force.

A third aspect of the present invention provides a mounted structure of an on-connector cover in that, in the mounted structure of an on-connector cover of the second aspect, locating wall portions which vertically extend are formed on forward end portions of the cover-guiding wall portions of the connector; and the on-connector cover is formed with a protruding portion which is inserted into between the locating wall portions in a state of this cover having the connector fitted thereto.

Accordingly, by the protruding portion of the on-connector cover being inserted in between the locating wall portions of the connector side, it is possible to further increase the area at and by which the connector side and the on-connector cover side are engaged with each other. Accordingly, the load applied to the on-connector cover can be dispersed into the area of engagement. And therefore it is possible to prevent the shear stress from being concentrated on a particular portion. Accordingly, the mounted structure of an on-connector cover is obtained with a high durability.

A fourth aspect of the present invention provides a mounted structure of an on-connector cover in that, in the mounted structure of an on-connector cover of the first to third aspect, a hood portion extending downwardly is formed on a rear portion of the on-connector cover; and the cover-guiding wall portions and the guiding groove portions are formed at least with respect to lower portions on each side of the connector and on-connector cover.

In the mounted structure of an on-connector cover according to the fourth aspect, by forming the downwardly extending hood portion at the lower portion of the rear end of the on-connector cover, the efficiency of bundling the distributed wires is enhanced. Also, even when having provided the hood portion, since the portions at which the connector side and the on-connector cover side are engaged with each other are situated on the lower portions on each side wall thereof near the hood portion, the following advantage exists. Namely, even when a load pressing the hood portion in a rearward, oblique upward direction is generated, the distance from the load applied position to the fulcrum is short. For this reason, the length of the arm corresponding to the moment of the stress is short and this decreases the load-multiplying action. And from this, there is obtained the effect of suppressing the occurrence of partial damages.

BRIEF DESCRIPTION OF THE DRAWING

The above and further objects and novel features of the present invention will more fully appear from the following detailed description when the same is read in conjunction with the accompanying drawings, in which.

DESCRIPTION OF THE PREFERRED EMBODIMENTS

Figure 1:
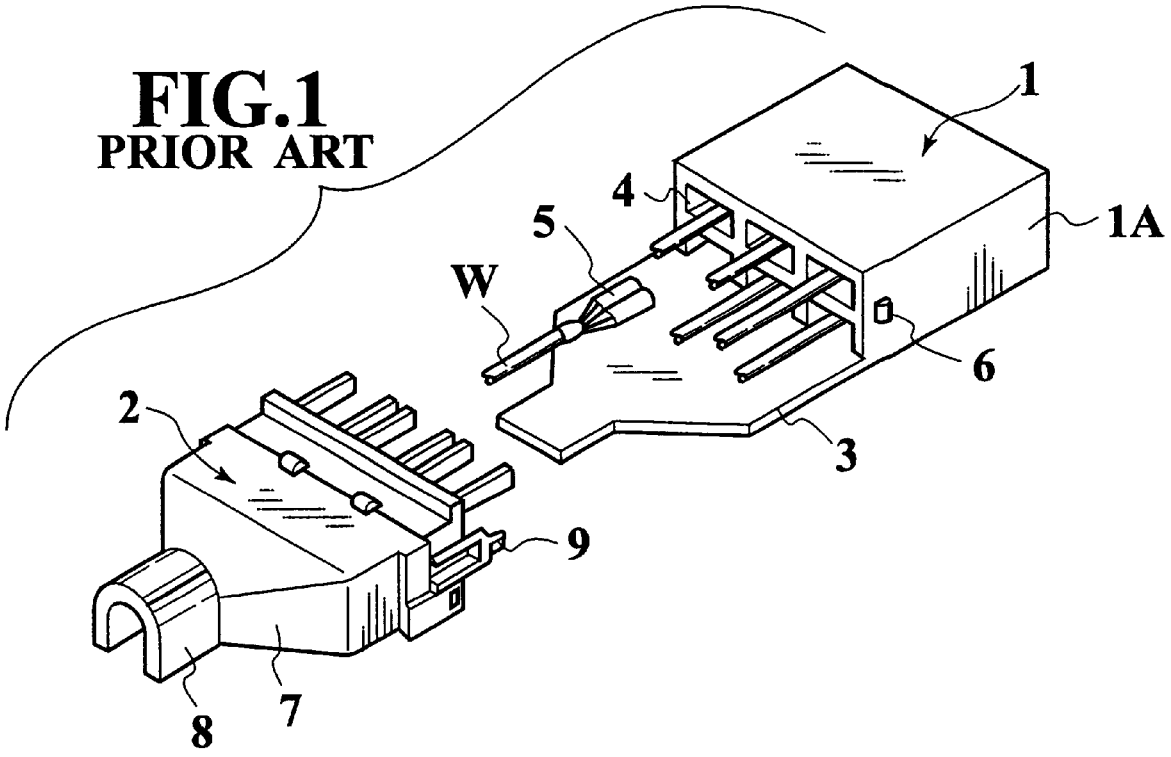
FIG.1 PRIOR ART
FIG. 1 is a perspective view illustrating a conventional on-connector cover.

There will be detailed below the preferred embodiments of the present invention with reference to the accompanying drawings. Like members are designated by like reference characters.

Figure 2:
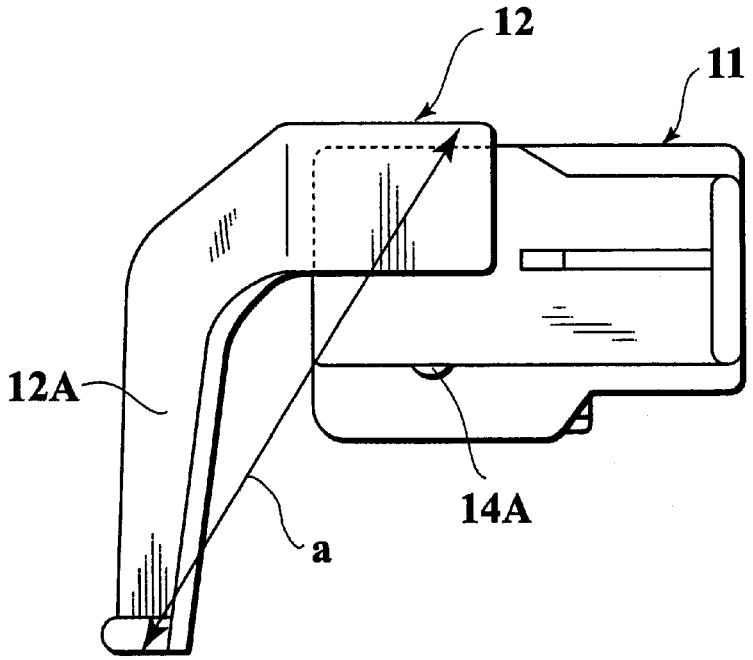
FIG. 2 is a side view illustrating an improved mounted structure of an on-connector cover.
Figure 3:
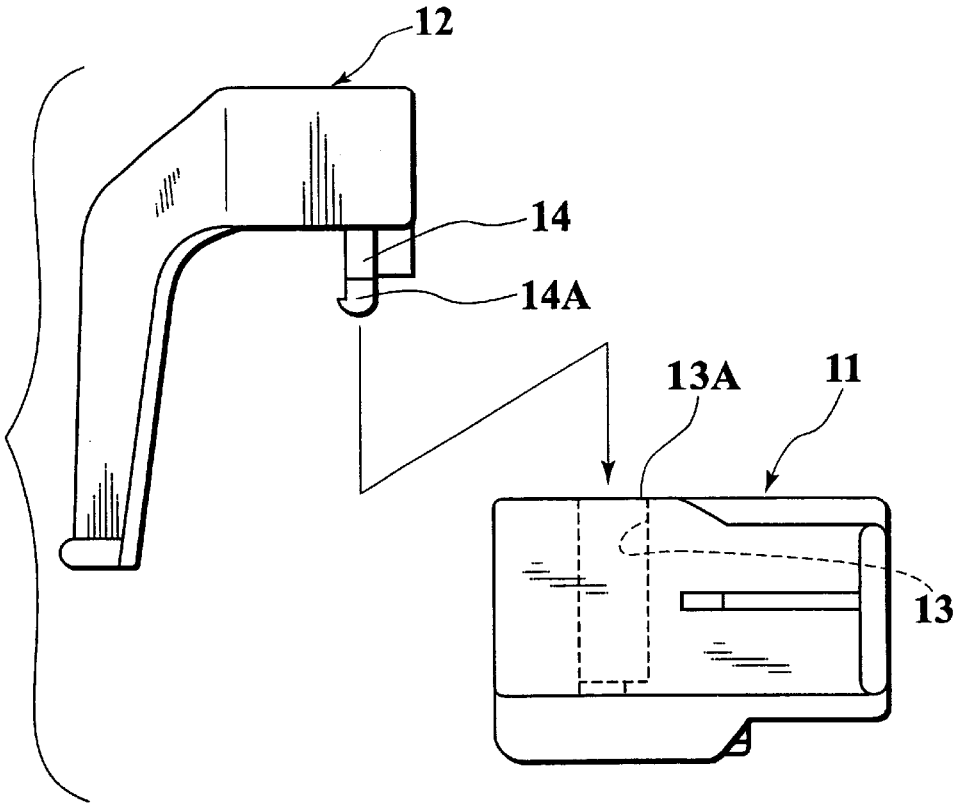
FIG. 3 is a side view illustrating a method of mounting the on-connector cover illustrated in FIG. 2.
Figure 4:
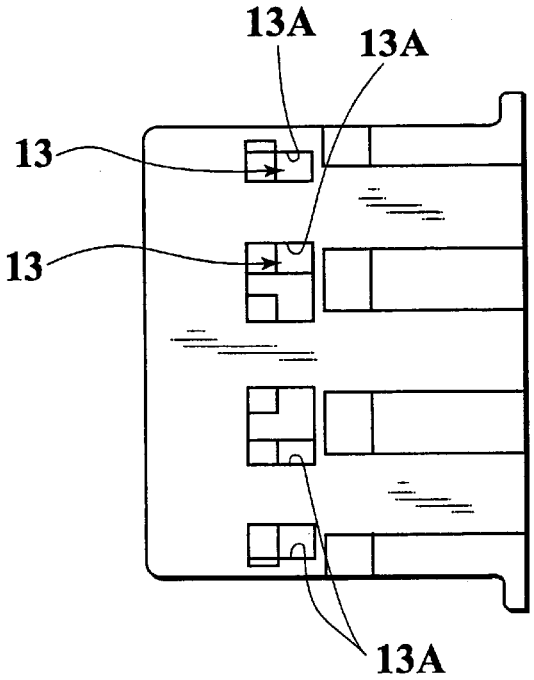
FIG. 4 is a plan view illustrating a connector on which the on-connector cover illustrated in FIG. 3 is mounted.

Referring now to FIGS. 2 to 4, a first embodiment according to the present invention will be described. FIG. 2 is a side view illustrating a state where an on-connector cover 12 is assembled to a connector 11. FIG. 3 is a side view illustrating a method of assembling. And FIG. 4 is a plan view illustrating the connector 11.

The construction of this on-connector cover 12 will hereafter be explained along with the construction of the connector 11. The connector 11 is substantially in the form of a rectangular parallelopiped, within that a plurality of terminal insertion through-holes (not illustrated) are formed along the leftward/rightward direction of FIG. 2. In these terminal insertion through-holes, there are inserted and disposed terminal metal fittings not illustrated, respectively. Also, it is arranged that electric wires similarly not illustrated be connected to their corresponding terminal metal fittings. In an upper surface of the connector 11, as illustrated in FIG. 4, there are formed insertion hole opening portions 13A of engaging/retaining insertion holes 13 that have been formed in the vertical direction. The on-connector cover 12 is mounted on the connector 11 in such a way as to cover a rear portion of the upper surface, and a rear side, of this connector 11. And in the underside of the on-connector cover 12 there are projectingly provided a plurality of engaging/retaining pieces 14 so that these pieces may be directed downward. In this construction, the on-connector 12 has its engaging/retaining pieces 14 inserted into the engaging/retaining insertion holes 13 of the connector 11. And, as illustrated in FIG. 2, by forward ends 14A of the engaging/retaining pieces 14 being engaged with and retained by the connector 11 side, the cover 12 is retained by the connector 11.

In the above-described techniques, although the engaging/retaining pieces 14 of the on-connector cover 12 are relatively deeply inserted into their corresponding engaging/retaining insertion holes 13 of the connector 11, the portion of the cover 12 that covers a rear end portion of the connector 11 is not retained by the connector 11 side. For this reason, the length of the arm corresponding to the stress moment of the on-connector cover 12 covers the length of an arrow (a) in FIG. 2. As a result, the latter conventional technique has the point of problem that the retention strength of the on-connector cover 12 is low none the less. Namely, because the stress is concentrated on a base portion of the engaging/retaining piece 14, there was the problem that cracks were likely to occur in the base portion of the engaging/retaining piece 14.

Further, in this mounted structure, in order to increase the mechanical strength of the engaging/retaining piece 14, there is the need to equip the on-connector cover 12 with a plurality of the engaging/retaining pieces 14. And in correspondence with this there is also the need to form a plurality of the engaging/retaining piece insertion holes 13 on the connector 11 side. Therefore, in a case where the connector has a small size of connector housing, there is the point of problem that the above-described mounted structure is not suitable.

In this connection, the inventors have improved another mounted structure of an on-connector cover as another embodiment which will be described hereinafter, referring to FIGS. 5 to 10.

Figure 7:
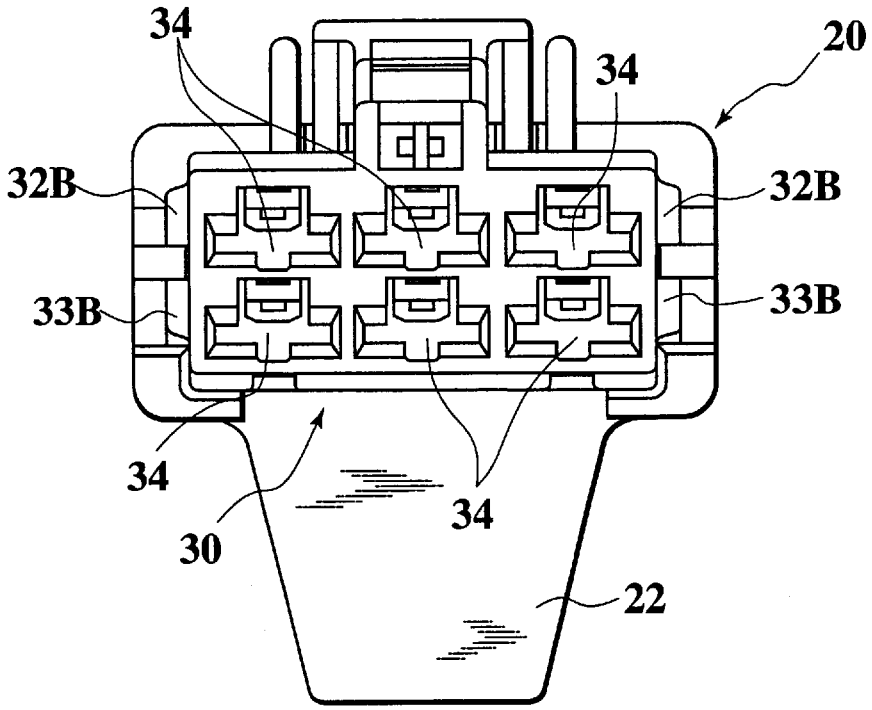
FIG. 7 is a front view illustrating a cover-mounted state according to the embodiment of the present invention.
Figure 8:
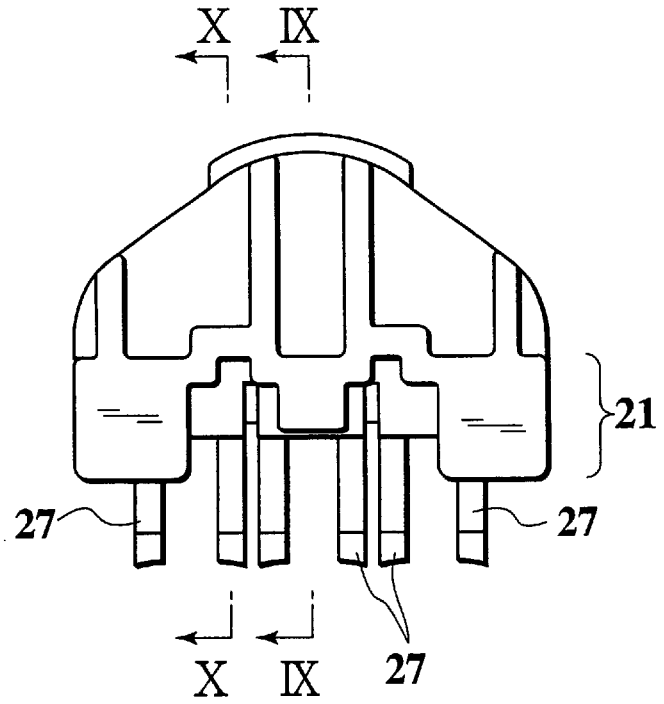
FIG. 8 is a plan view illustrating an on-connector cover according to the embodiment of the present invention.

Before explaining the construction of an on-connector cover 20 of a second embodiment, the construction of a connector 30 will be explained. In the connector 30, on each of both side surfaces of a rear portion of a connector main body 31 shaped substantially in the form of a rectangular parallelopiped there are formed a pair of upper/lower protrusion portions 32 and 33. These protrusion portions 32 and 33 respectively have cover-guiding wall portions 32A and 33A parallel with each other and locating wall portions 32B and 33B extended from forward end portions of the cover-guiding wall portions 32A and 33A in such a way as to approach each other and situated opposing each other with a prescribe distance existing in between. It is to be noted that, within the connector main body 31, as illustrated in FIG. 7, there are formed a plurality of terminal accommodation spaces. 34. And it is arranged that within this terminal accommodation space 34 there be accommodated from a rear end surface side a corresponding terminal metal fitting that an electric wire not illustrated is connected to.

Figure 6:
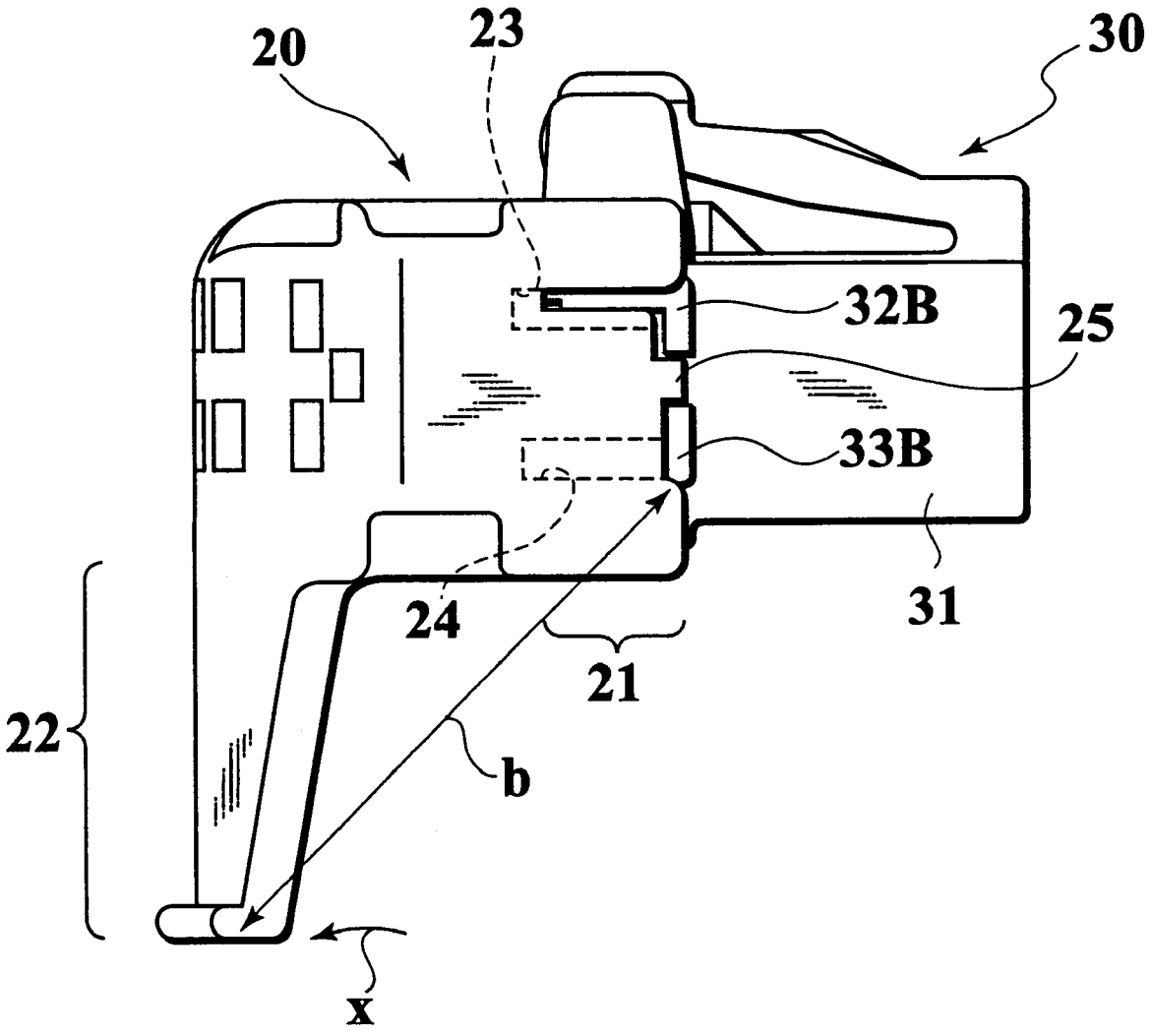
FIG. 6 is a side view illustrating a cover-mounted state according to the embodiment of the present invention.

The on-connector cover 20 has on a frontward portion thereof a fitting portion 21, the configuration of that is shaped like a horizontally thrown U in section, and that is superposed on an upper surface and left and right side surfaces of the rear portion of the connector 30 in such a way as to cover these surfaces. The on-connector cover 20 has on a rear portion thereof a hood portion 22 that downwardly vertically extends. In inner surfaces of both side walls of the fitting portion 21 there are parallel-formed guiding groove portions 23 and 24 corresponding to the cover-guiding wall portions 32A and 33A formed on each of the both side surfaces of the connector main body 31. Also, between these guiding groove portions 23 and 24 in the frontward ends on both side walls of the fitting portion 21 there are formed protruding portions 25 that forwardly protrude and have a prescribed width dimension. Each of these protruding portions 25 has its dimension so set as to be closely inserted into the space between the locating wall portions 32B and 33B situated in opposition that are formed on both side surfaces of the connector main body 31. FIG. 6 illustrates a state where the on-connector cover 20 has been mounted on the connector 30 and the protruding portions 25 have been thereby inserted in between the locating wall portions 32B and 33B.

Figure 9:
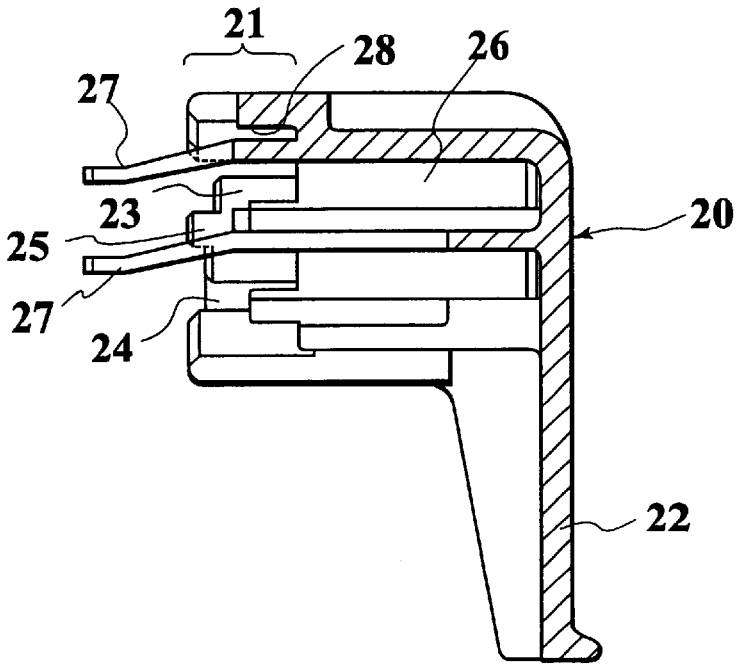
FIG. 9 is a sectional view taken along a line IX—IX of FIG. 8.
Figure 10:
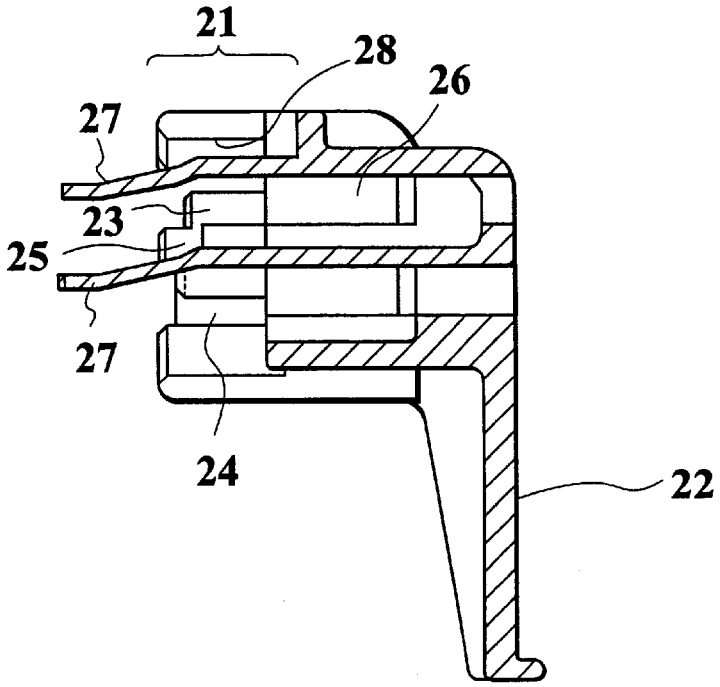
FIG. 10 is a sectional view taken along a line X—X of FIG.

Also, in the interior of the on-connector cover 20, there are formed a plurality of ribs 26 along the back-and-forth direction of the on-connector cover 20 as illustrated in FIGS. 9 and 10, thereby increasing the rigidity of the on-connector cover 20. It is to be noted that FIG. 9 illustrates a section taken along a line IX—IX of FIG. 8 while FIG. 10 illustrates a section taken along a line X—X of FIG. 8. Further, on the frontward end surface of the on-connector cover 20 there are projectingly provided a plurality of engaging protruding pieces 27 in such a way as for them to be directed frontward. Also, in an upper portion of the frontward end of the on-connector cover 20 there are formed engaging groove portions 28 that are engaged with the connector 30 side.

Figure 5:
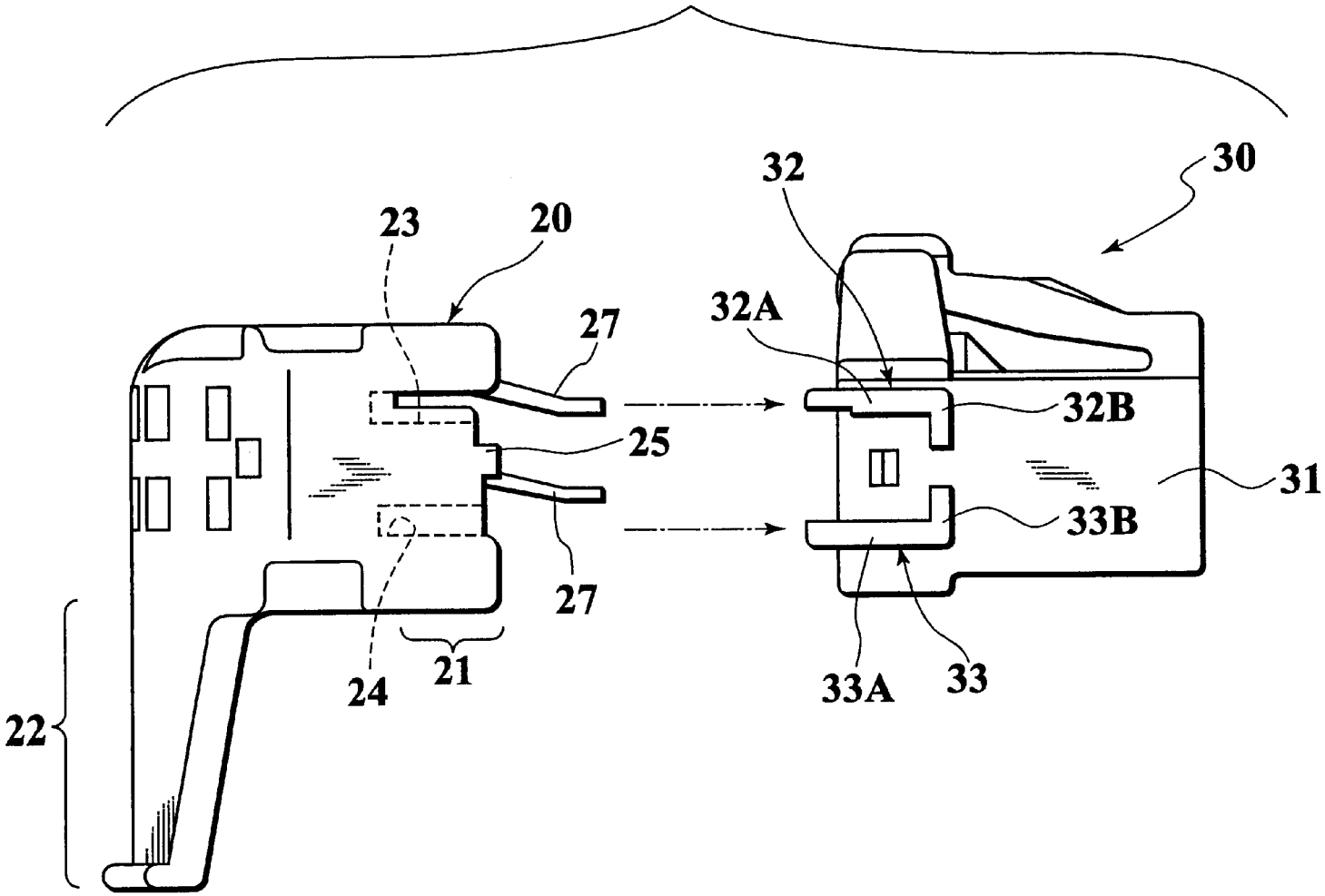
FIG. 5 is a side view illustrating an embodiment of a mounted structure of an on-connector cover according to the present invention.

The constructions of the connector 30 and the on-connector cover 20 have been explained as above. Next, a method of mounting the on-connector cover 20 onto the connector 30 will be explained with the use of FIG. 5. As illustrated in FIG. 5, the method is first to cause the frontward end surface of the on-connector cover 20 to oppose the rearward end surface of the connector 30. The method is then to insert the engaging protruding pieces 27 of the on-connector cover 20 into insertion openings not illustrated on the connector 30 side. Subsequently, the method is to cause the on-connector cover 20 to come nearer to the connector 30, thereby bringing the guiding groove portions 23 and 24 of the on-connector cover 20 side into alignment with the locating wall portions 32B and 33B of the connector 30 side. The method is further to force the on-connector cover 20 into the connector 30 side so as for the locating wall portions 32B and 32B to be relatively inserted into the guiding groove portions 23 and 24. The method is thereby to insert the protruding portions 25 of the on-connector cover 20 into between the 32A and the 32B. And the method is then to insert engaging protrusions not illustrated formed on the connector 30 side into engaging groove portions 28 formed in an upper portion of the frontward end of the on-connector cover 20. By doing so, it is possible to mount the on-connector cover 20 to the connector 30.

Next, the function of the on-connector cover 20 of this embodiment will be explained. Suppose now that the on-connector cover 20 is in a state of its having been mounted on the connector 30. When in this state a load acting in a direction indicated by an arrow x in FIG. 6 has been applied, the distance indicated by an arrow b in the same figure substantially corresponds to the length of the arm that represents the moment of the stress. Namely, the portion at which the cover-guiding wall portion 33A is engaged with the guiding groove portion 24 serves as a fulcrum that supports the load. Assuming that the hood 12A of the convention improved on-connector cover 12 illustrated in FIG. 2 be substantially the same in length as the hood portion 22 of the on-connector cover 20 of this embodiment, the following is seen from this. Namely, in this embodiment, the length of the arm of the stress moment is shorter and therefore the load multiplying effect is small. And accordingly the mounted structure of an on-connector cover 20 is unlikely to be impaired due to the load applied thereto. Also, in the fitting portion 21 of this embodiment, construction is made such that the guiding groove portions 23 and 24 and the protruding portions 25 are engaged with the locating wall portions 32B and 32B and the locating wall portions 32B and 32B of the connector 30 side. Therefore, when the load acting in the x-indicated direction of FIG. 6 has been applied, the strength with which the on-connector cover 20 is retained by the connector 30 is large and so the on-connector cover 20 remains unlikely to be disengaged. Also, because the area of engagement between the connector 30 side and the on-connector cover 20 side is large, this embodiment has the function of mitigating the load applied to each portion of engagement. Further, because it is possible to design the configuration of the on-connector cover 20 by utilizing the configuration of the connector 30, it is possible to apply the structure of the on-connector 20 of this embodiment even to a small-sized connector 30. Therefore, it is possible to obtain a stable force of retaining even regarding the small-sized connector 30.

Although the embodiments of the present invention have been explained as above, the invention is not limited thereto and permits various changes in design to be made which are incidental to the subject matter of Its construction. For instance, although in the above-described embodiment there has been provided on the on-connector cover 20 the hood portion 22 that extends downwardly at the rear portion thereof, the direction in that the hood portion 22 extends is not limited thereto. Also, a construction having no hood portion 22 may be also adopted. Also, although in the above-described embodiment there have been provided the engaging protruding pieces 27 forwardly protruding from the on-connector cover 20, such protruding pieces may be omitted as the occasion demands correspondingly to the corresponding connector. Further, although in the above-described embodiment construction has been made such that the two guiding groove portions 23 and 24 are formed in the inner surface of the side wall of the on-connector cover 20, a construction having a single piece of groove portion may be also adopted. It is to be noted that as the connector that the on-connector cover is mounted on there are applied various kinds of connectors in addition to a male connector, a female connector, etc.

The entire contents of Japanese Patent Application P11-155374 (filed Jun. 2, 1999) are incorporated herein by reference.

Although the invention has been described above by reference to certain embodiments of the invention, the invention is not limited to the embodiments described above. Modifications and variations of the embodiments descried above will occur to those skilled in the art, in light of the above teachings. The scope of the invention is defined with reference to the following claims.

What is claimed is:

1. A mounted structure of an on-connector cover comprising:

a connector adapted to receive an electrical wire such that the electrical wire extends from a rear end of the connector; and an on-connector cover covering the rear end of the connector and covering at least three side portions abutting the rear end of the connector, wherein cover-guiding wall portions are formed on each of both side walls of the connector;

guiding groove portions into which the cover-guiding wall portions are respectively inserted are formed in each of both side walls of the on connector cover, the cover-guiding wall portions are formed two or more in number on each side wall of the connector so as to become parallel with each other, and in each of an inner surface of the side walls of the on-connector cover, the guiding groove portions that are the same in number as the cover-guiding wall portions are formed in correspondence with the cover-guiding wall portions.

2. A mounted structure of an on-connector cover according to claim 1, wherein a hood portion protrudes from a rear portion of the on-connector cover; and the cover-guiding wall portions and the guiding groove portions are formed at least with respect to lower portions on each side of the connector and on-connector cover.

3. A mounted structure of an on-connector cover according to claim 1, wherein a hood portion protrudes from a rear portion of the on-connector cover; and the cover-guiding wall portions and the guiding groove portions are formed at least with respect to lower portions on each side of the connector and on-connector cover.

4. A mounted structure of an on-connector cover according to claim 1, wherein the cover-guiding wall portions have locating wall portions which perpendicularly extend from forward end portions of the cover-guiding wall portions of the connector; and the on-connector cover is formed with a protruding portion which is inserted between the locating wall portions in a state of the cover having the connector fitted thereto.

5. A mounted structure of an on-connector cover; and claim 4, wherein a hood portion protrudes from a rear portion of the on-connector cover; and the cover-guiding wall portions and the guiding groove portions are formed at least with respect to lower portions on each side of the connector and on-connector cover.

6. A cover mounting structure comprising:

a connector adapted to receive an electric wire such that the electrical wire extends from a rear surface thereof, said connector having engaging portions extending generally parallel to one another; and a cover configured to cover said rear surface of said connector and configured to cover at least three side portions abutting said rear surface of said connector, said cover having engaging portions extending generally parallel to one another, said engaging portions of said cover being configured to engage with said engaging portions of said connector when said cover is positioned to cover said rear surface of said connector, wherein said engaging portions of said connector comprise at least two parallel cover-guiding wall portions on each of two side walls of said connector, and said engaging portions of said cover comprise at least two parallel guiding groove portions corresponding to said at least two parallel cover-guiding wall portions on each of said two side walls of said connector.

7. A cover mounting structure according to claim 6, wherein:

said cover includes a hood portion that protrudes from a rear portion thereof; and said engaging portions of said connector and said engaging portions of said cover are formed at least with respect to lower portions of each side of said connector and cover.

8. A cover mounting structure according to claim 6, wherein:

said cover includes a hood portion that protrudes from a rear portion thereof; and said engaging portions of said connector and said engaging portions of said cover are formed at least with respect to lower portions of each side of said connector and cover.

9. A cover mounting structure according to claim 6, wherein:

said engaging portions of said connector have locating wall portions that perpendicularly extend from forward end portions of said engaging portions of said connector; and said cover includes a protruding portion inserted between said locating wall portions when said cover is positioned to cover said rear surface of said connector.

10. A cover mounting structure according to claim 9, wherein:

said cover includes a hood portion that protrudes from a rear portion thereof; and said engaging portions of said connector and said engaging portions of said cover are formed at least with respect to lower portions of each side of said connector and cover.

* * * * *